US009995057B2

(12) United States Patent
Wu

(10) Patent No.: US 9,995,057 B2
(45) Date of Patent: Jun. 12, 2018

(54) CANOPY FRAME FOR ALLEVIATING STANDING WATER

(71) Applicant: Guoxiang Wu, Ningbo (CN)

(72) Inventor: Guoxiang Wu, Ningbo (CN)

(73) Assignee: NINGBO CASUALWAY LEISURE PRODUCTS CO., LTD., Ningbo (CN)

( * ) Notice: Subject to any disclaimer, the term of this patent is extended or adjusted under 35 U.S.C. 154(b) by 0 days. days.

(21) Appl. No.: 15/597,173

(22) Filed: May 17, 2017

(65) Prior Publication Data

US 2018/0058091 A1 Mar. 1, 2018

(30) Foreign Application Priority Data

Aug. 26, 2016 (CN) ..... 2016 2 0954296 U

(51) Int. Cl.

| | |
|---|---|
| ***E04H 15/46*** | (2006.01) |
| ***E04H 15/50*** | (2006.01) |
| ***E04H 15/40*** | (2006.01) |
| ***E04H 15/54*** | (2006.01) |

(52) U.S. Cl.

CPC ..... *E04H 15/46* (2013.01); *E04H 15/405* (2013.01); *E04H 15/50* (2013.01); *E04H 15/54* (2013.01)

(58) Field of Classification Search

CPC ..... E04H 15/48; E04H 15/50; E04H 15/44; E04H 15/34; E04H 15/46; E04H 15/505

USPC ..... 135/121, 135, 138, 139, 143–147, 131, 135/140

See application file for complete search history.

(56) References Cited

U.S. PATENT DOCUMENTS

| | | | | |
|---|---|---|---|---|
| 1,666,757 | A * | 4/1928 | Snyder | E04H 15/28 135/116 |
| 1,728,356 | A * | 9/1929 | Morgan | E04H 15/50 135/154 |
| 6,708,707 | B2 * | 3/2004 | Dotterweich | E04H 15/50 135/131 |
| 6,868,858 | B2 * | 3/2005 | Suh | E04H 15/50 135/131 |
| 6,874,519 | B2 * | 4/2005 | Chiang | E04H 15/50 135/131 |
| 7,360,549 | B2 * | 4/2008 | Seo | E04H 15/44 135/145 |
| 7,422,026 | B2 * | 9/2008 | Kim | E04H 15/50 135/120.2 |
| 7,836,908 | B2 * | 11/2010 | Sy-Facunda | E04H 15/50 135/122 |
| 8,418,711 | B2 * | 4/2013 | Park | E04H 15/50 135/145 |
| 9,303,428 | B1 * | 4/2016 | Wu | E04H 15/50 |

(Continued)

FOREIGN PATENT DOCUMENTS

| | | | | |
|---|---|---|---|---|
| JP | 2006328929 A | * 12/2006 | | E04H 15/44 |
| WO | WO 2005024158 A1 | * 3/2005 | | E04H 15/50 |

*Primary Examiner* — Winnie Yip

(74) *Attorney, Agent, or Firm* — Gokalp Bayramoglu

(57) ABSTRACT

The present disclosure provides a frame for tents or canopies which alleviates standing water during rainy outdoor weather. The frame comprises a plurality of foot poles, a plurality of hinged beam assemblies, a plurality of frame supporting poles and a top plate. Each foot pole is hinged to one frame supporting pole, each frame supporting pole is connected to the top plate, and each hinged beam assembly connects two adjacent foot poles of the plurality of foot poles. The disclosed frame provides increased frame strength and stability.

14 Claims, 3 Drawing Sheets

(56) References Cited

U.S. PATENT DOCUMENTS

| | | | | |
|---|---|---|---|---|
| 2004/0084074 | A1* | 5/2004 | Chiu | E04H 15/50 135/131 |
| 2015/0247339 | A1* | 9/2015 | Lee | E04H 15/50 135/145 |
| 2015/0308147 | A1* | 10/2015 | Lee | E04H 1/1205 135/145 |

* cited by examiner

CANOPY FRAME FOR ALLEVIATING STANDING WATER

CROSS REFERENCE

This application claims priority from Chinese Application No. 201620954296.5, filed on Aug. 26, 2016, the entire contents of which are incorporated herein by reference.

TECHNICAL FIELD

The present disclosure relates to an outdoor canopy, and in particular, to a canopy frame for alleviating standing water.

BACKGROUND OF THE INVENTION

Canopies and tents are outdoor products commonly used in daily activities. A canopy or tent usually comprises a frame and tarpaulin, wherein the frame can be configured as a foldable structure to facilitate transport. In prior arts, folding is enabled by applying a connecting structure between hinged crossbeams and foot supporting poles so that the canopy or tent can be folded and unfolded when required. As shown is FIG. 1, an existing canopy frame comprises foot poles 01, hinged beam assemblies 02, frame supporting poles 03 and a top plate 04. Every frame supporting pole 03 is connected to the top plate 04 on one end, and the top of a foot pole 01 on the other end. The bottom end of a foot pole 01 is in contact with ground during usage. Two adjacent foot poles 01 are connected by one hinged beam assembly 02. Each hinged beam assembly 02 comprises at least one hinged beam unit with adjacent hinged beam units hinged to each other on the ends thereof. When the canopy is unfolded during usage, the hinged beam units are stretched and the tarpaulin is supported by the frame supporting poles 03. When the canopy is folded after usage, the hinged beam units are also folded to save space. However, the existing canopies are associated with various defects, such as an unstable supporting structure and vulnerability to lateral deformation which tend to break junction points, because the hinged beam assembly 02 forms a diamond shape. Especially, when the distance between adjacent foot poles grows larger, the hinged beam assembly 02 becomes more vulnerable to later bending. The canopy suffers from a short life time since the hinged beam assembly 02 may bend or break due to excessive external force. Another defect associated with prior art canopies is that standing water would gather on the tarpaulin between two frame supporting poles 03, causing tearing of the tarpaulin and crushing of the canopy frame, and finally leads to permanent damage to the canopy.

SUMMARY OF THE INVENTION

One of the objectives of the present disclosure is to solve at least some problems of the prior art by providing a canopy frame with increased frame strength and increased stability of supporting cross beams. The tent frame according to the present disclosure also alleviates the standing water problem.

The present disclosure discloses a canopy frame comprising a plurality of foot poles, a plurality of hinged beam assemblies, a plurality of frame supporting poles and a top plate, wherein each of the plurality of foot poles is hinged to one of the plurality of frame supporting poles. Each of the plurality of frame supporting poles is connected to the top plate, and each hinged beam assembly connects two adjacent foot poles of the plurality of foot poles.

In some embodiments, the canopy frame further comprises a plurality of pull rods and a top plate supporting assembly located below the top plate, wherein each pull rod is hinged to the top plate on one end and a hinged beam assembly on the other end, and the top plate supporting assembly is hinged to each frame supporting pole and each pull rod.

In some embodiments, each hinged beam assembly comprises two or more hinged beam units, and each hinged unit comprises a first eave pole and a second eave pole.

In some embodiments, the first eave pole and the second eave pole of each hinged unit are hinged to each other at a middle hinge point to form an X-shape in an unfolded configuration of the canopy frame.

In some embodiments, a first eave pole of a first hinged beam unit is hinged to a second eave pole of a second hinged beam unit which is adjacent to the first hinged beam unit at a top hinge point.

In some embodiments, a second eave pole of the first hinged beam unit is hinged to a first eave pole of the second hinged beam unit which is adjacent to the first hinged beam unit at a bottom hinge point.

In some embodiments, each pull rod is hinged to the top hinge point.

In some embodiments, each pull rod is hinged to the middle hinge point.

In some embodiments, each pull rod is hinged to the bottom hinge point.

In some embodiments, the top plate supporting assembly comprises a bottom plate and a plurality of auxiliary supporting poles, wherein the bottom plate is located below the top plate, and each auxiliary supporting pole is hinged to the bottom plate on one end and one of a frame supporting pole and a pull rod on the other end.

In some embodiments, each frame supporting pole is foldable.

In some embodiments, each poll rod is foldable.

Some of the advantages provided with the canopy frame according to the present disclosure are listed as follows:

1) Pull rods are arranged between a hinge point on the hinged beam assembly and the top plate. In one aspect, the pull rods prevent distortion of the hinged beam assembly by providing increased strength, and provide a supporting structure on the slope area of the tarpaulin where standing water tends to accumulate. In another aspect, the pull rods fold or unfold synchronously with the frame with the help of the auxiliary supporting poles. The frame supporting poles thus become more firmly supported in the unfolded configuration of the canopy. The resulted canopy frame benefits from a more stable structure by connecting the components as described above. Standing water on the tarpaulin would also flow downward with improved efficiency.
2) The pull rod may connect to the hinged beam assembly on a top hinge point so that the pull rod provides extra support to the tarpaulin to alleviate standing water.
3) The frame supporting poles and pull rods may be configured foldable to reduce the size of the folded canopy while maintaining an integrated structure.

BRIEF DESCRIPTION OF THE DRAWINGS

Embodiments of the invention are illustrated by way of example, and not by way of limitation, in the figures of the accompanying drawings in which reference numerals refer to similar elements.

REFERENCE NUMBERS

01, foot pole; 02, hinged beam assembly; 03, frame supporting pole; 04, top plate; 1, foot pole; 2, hinged beam assembly; 2-1, first eave pole; 2-2, second, eave pole; 2-3, third eave pole; 2-4, fourth eave pole; 201, first hinged beam unit; 202, second hinged beam unit; 3, frame supporting pole; 4, top plate; 5, pull rod; 6, top hinge point; 7, Bottom hinge point; 8, bottom plate; 9, auxiliary supporting pole, 10, middle hinge point.

DETAILED DESCRIPTION

The following description is presented to enable those skilled in the art to make and use the embodiments, and is provided in the context of a particular application and its requirements. Various modifications to the disclosed embodiments will be readily apparent to those skilled in the art upon reading the following description, and the general principles defined herein may be applied to other embodiments and applications without departing from the spirit and scope of the present disclosure. Therefore, the present disclosure is not limited to the embodiments shown, but is to be accorded the widest scope consistent with the principles and concepts disclosed herein.

Figure 1:
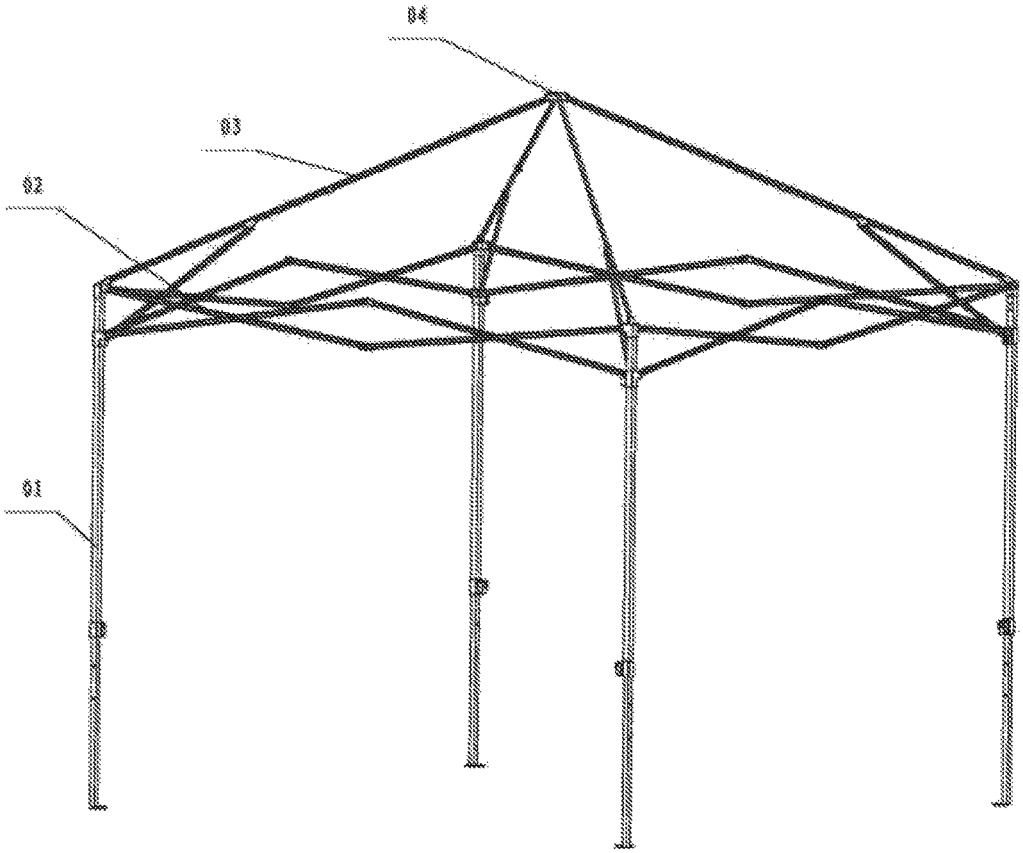
Figure 1 (Prior Art)
FIG. 1 is a schematic illustration of a canopy frame of prior arts.
Figure 2:
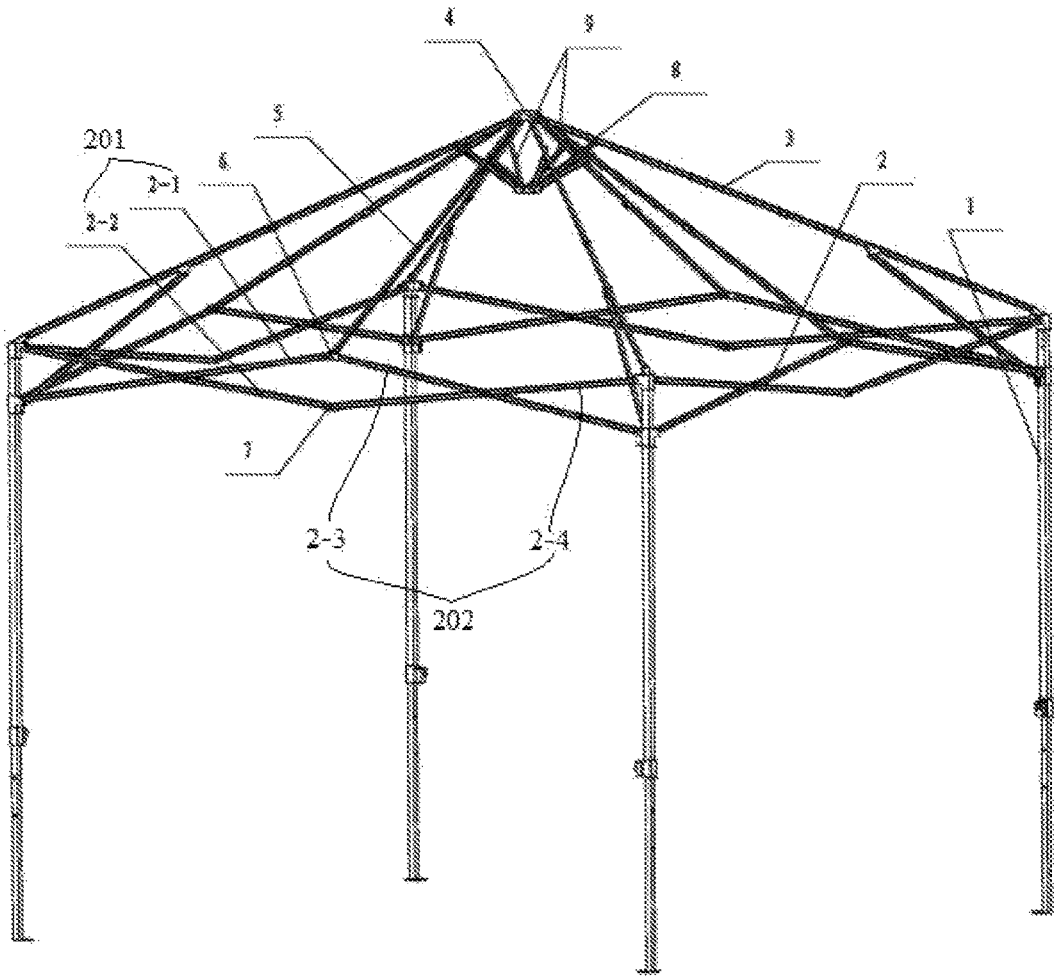
FIG. 2 is a schematic illustration of a canopy frame according to an embodiment of the present disclosure.

In FIG. 2, a canopy frame according to an embodiment of the present disclosure comprise 3 plurality of foot poles 1, a plurality of hinged beam assemblies 2, a plurality of frame supporting poles 3 and a top plate 4. The foot pole 1 is deployed vertically with one end in contact with ground during usage. The other end of the foot pole 1 is hinged to a frame supporting pole 3. Each frame supporting pole 3 is connected to the top plate 4. Two adjacent foot poles 1 are interconnected by one corresponding hinged beam assembly 2.

The canopy frame further comprises a plurality of pull rods 5 and a top plate supporting assembly located below the top plate. Each pull rod 5 is hinged to the top plate 4 on one end and a hinged beam assembly 2 on the other end. The top plate supporting assembly is hinged to each frame supporting pole 3 and each pull rod 5. In some embodiments, the top plate supporting assembly comprises a bottom plate 8 and a plurality of auxiliary supporting poles 9. The bottom plate is located below the top plate 4. Each auxiliary supporting pole 9 is hinged to the bottom plate 8 on one end, and to the frame supporting pole 3 or pull rod 5 on the other end, so that frame strength may be increased. Preferably, the frame supporting poles and the pull rods 5 are designed as foldable components.

The hinged beam assembly 2 comprises two or more hinged beam units. Each hinged unit comprises a first eave pole 2-1 and a second eave pole 2-2 which are hinged to each other at a middle hinge point 10 which keeps a distance from either end of an eave pole. In particular, the first eave pole 2-1 and the second eave pole 2-2 forms an X-shape structure in an unfolded configuration of the canopy frame. In the embodiment as shown in FIG. 2, the hinged beam assembly 2 includes two hinged beam units or four eave poles. The first hinged beam unit 201 includes a first eave pole 2-1 and a second eave pole 2-2. The second hinged beam unit 202 includes a third eave pole 2-3 and a fourth eave pole 2-4.

Figure 3:
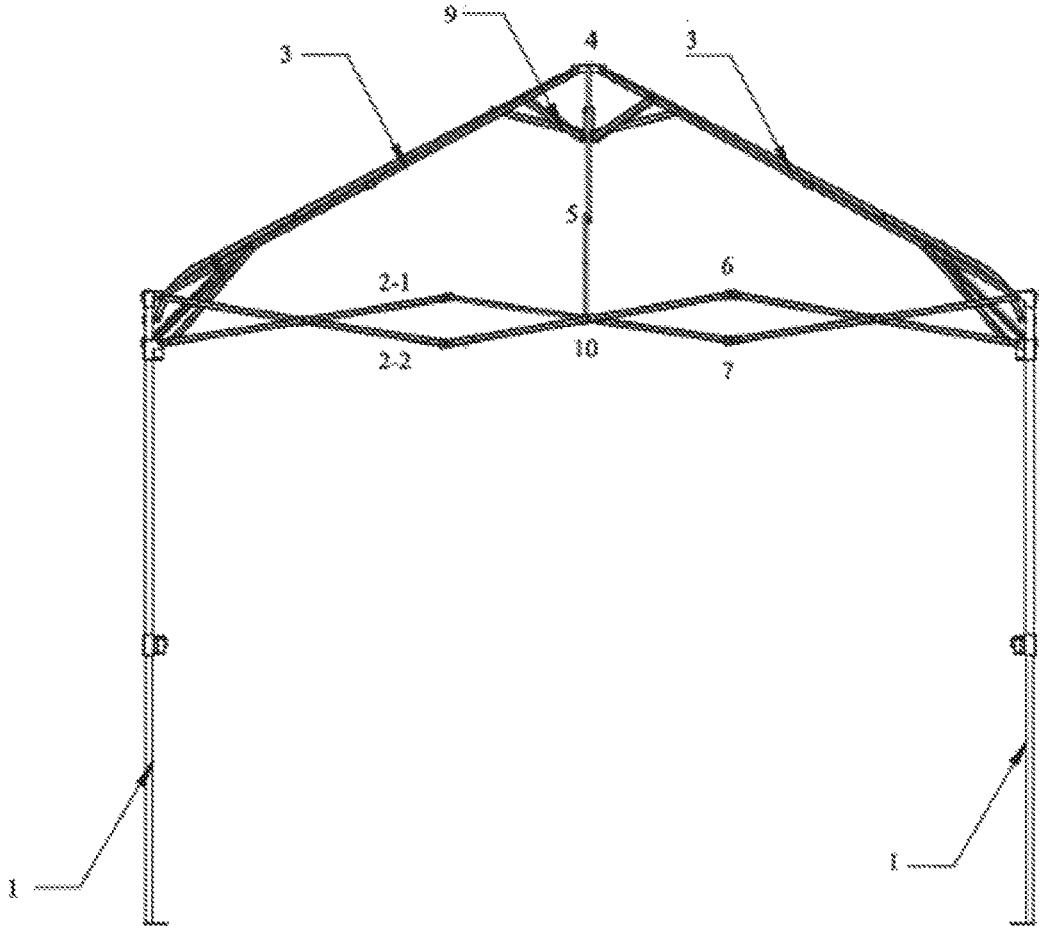
FIG. 3 is a schematic illustration of a canopy frame according to another embodiment of the present disclosure.

In the embodiment as shown in FIG. 3, the hinged beam assembly 2 includes three hinged beam units or six eave poles. The number of hinged beam units included in the hinged beam assembly 2 is not limited to the two embodiments.

The eave poles of adjacent hinged beam units are connected to each other in a zigzag manner. For example, the first eave pole 2-1 of a first hinged beam unit is hinged to a second eave pole 2-2 of a second hinged beam unit which adjacent to the first hinged beam unit at a top hinge point 6. Similarly, the second eave pole 2-2 of the first hinged beam unit is hinged to a first eave pole 2-1 of the second hinged beam unit at a bottom hinge point 7. The exception is that eave poles on the two ends of a hinged beam assembly 2 are connected to corresponding foot poles 1 as shown in FIGS. 2 and 3.

In some embodiments, each pull rod 5 is hinged to any one of the top hinge point 6, the middle hinge point 10 and the bottom hinge point 7 to increase frame strength and facilitate downward flowing of standing water.

As noted above, terminology used when describing certain features or aspects of the disclosure should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above detailed description explicitly defines such terms. Accordingly, the actual scope of the invention encompasses not only the disclosed examples, but also all equivalent ways of practicing or implementing the invention under the claims.

What is claimed is:

1. A canopy frame comprising:

a plurality of foot poles;

a plurality of hinged beam assemblies;

a plurality of frame supporting poles;

a top plate;

a plurality of pull rods; and a top plate supporting assembly, located below the top plate;

wherein each of the plurality of foot poles is hinged to one of the plurality of frame supporting poles;

each of the plurality of frame supporting poles is connected to the top plate;

each hinged beam assembly connects two adjacent foot poles of the plurality of foot poles;

each pull rod is hinged to the top plate on one end and to one of the plurality of hinged beam assemblies on an other end;

the top plate supporting assembly is hinged to each of the plurality of frame supporting poles and each pull rod;

the top plate supporting assembly comprises a bottom plate and a plurality of auxiliary supporting poles;

the bottom plate is located below the top plate;

each auxiliary supporting pole is hinged to the bottom plate on one end and one of a frame supporting pole and a pull rod on the other end; and a bottom surface of the top plate is spaced from a top surface of the bottom plate with a gap.

2. The canopy frame of claim 1, wherein each of the plurality of hinged beam assemblies comprises two or more hinged beam units; and each hinged beam unit comprises two eave poles.

3. The canopy frame of claim 2, wherein the two eave poles of said each hinged beam unit are hinged to each other at a middle hinge point to form an X-shape in an unfolded configuration of the canopy frame.

4. The canopy frame of claim 3, wherein the two or more hinged beam units comprises a first hinged beam unit and a second hinged beam unit;

the two eave poles of the first hinged beam unit includes a first eave pole and a second eave pole;

the two eave poles of the second hinged beam unit includes a third eave pole and a fourth eave pole;

when the first hinged beam unit is connected to the second hinged beam unit, the first eave pole of the first hinged beam unit is hinged to the third eave pole of the second hinged beam unit at a top hinge point.

5. The canopy frame of claim 4, wherein the second eave pole of the first hinged beam unit is hinged to the fourth eave pole of the second hinged beam unit at a bottom hinge point.

6. The canopy frame of claim 5, wherein each pull rod is hinged to the top hinge point.

7. The canopy frame of claim 6, wherein each pull rod is hinged to the middle hinge point.

8. The canopy frame of claim 6, wherein each pull rod is hinged to the bottom hinge point.

9. The canopy frame of claim 1, wherein each frame supporting pole is foldable.

10. The canopy frame of claim 5, wherein each pull rod is foldable.

11. A canopy frame consisting of:

a plurality of foot poles;

a plurality of hinged beam assemblies;

a plurality of frame supporting poles:

a top plate;

a plurality of pull rods; and a top plate supporting assembly, located below the top plate;

wherein each of the plurality of foot poles is hinged to one of the plurality of frame supporting poles;

each of the plurality of frame supporting poles is connected to the top plate;

each hinged beam assembly connects two adjacent foot poles of the plurality of foot poles;

each pull rod is hinged to the top plate on one end and to one of the plurality of hinged beam assemblies on another end;

the top plate supporting assembly is hinged to each of the plurality of frame supporting poles and each pull rod;

the top plate supporting assembly comprises a bottom plate and a plurality of auxiliary supporting poles;

the bottom plate is located below the top plate;

each auxiliary supporting pole is hinged to the bottom plate on one end and one of a frame supporting pole and a pull rod on the other end;

a bottom surface of the top plate is spaced from a top surface of the bottom plate with a gap;

wherein each of the plurality of hinged beam assemblies includes two or more hinged beam units and each hinged beam unit comprises two eave poles;

wherein the two eave poles of said each hinged beam unit are hinged to each other at a middle hinge point to form an X-shape in an unfolded configuration of the canopy frame;

wherein the two or more hinged beam units comprises a first hinged beam unit and a second hinged beam unit;

the two eave poles of the first hinged beam unit includes a first eave pole and a second eave pole;

the two eave poles of the second hinged beam unit includes a third eave pole and a fourth eave pole;

when the first hinged beam unit is connected to the second hinged beam unit, the first eave pole of the first hinged beam unit is hinged to the third eave pole of the second hinged beam unit at a top hinge point;

wherein the second eave pole of the first hinged beam unit is hinged to the fourth eave pole of the second hinged beam unit at a bottom hinge point;

wherein each pull rod is hinged to one of the top hinge point, the middle hinge point, or the bottom hinge point;

wherein each frame supporting pole is foldable;

wherein each pull rod is foldable.

12. The canopy frame of claim 11, wherein the each pull rod is hinged to the top hinge point.

13. The canopy frame of claim 11, wherein the each pull rod is hinged to the middle hinge point.

14. The canopy frame of claim 11, wherein the each pull rod is hinged to the bottom hinge point.

* * * * *